US005785544A

United States Patent [19]

Linden et al.

[11] Patent Number: 5,785,544

[45] Date of Patent: Jul. 28, 1998

[54] HERMETICALLY SEALED CONNECTOR DEVICE

[75] Inventors: Michael J. Linden, Wethersfield; Richard W. Morris, East Granby, both of Conn.

[73] Assignee: Combustion Engineering, Inc., Windsor, Conn.

[21] Appl. No.: 825,588

[22] Filed: Apr. 1, 1997

Related U.S. Application Data

[63] Continuation of Ser. No. 542,457, Oct. 12, 1995, abandoned.

[51] Int. Cl.[6] ..... H01R 13/52

[52] U.S. Cl. ..... 439/278; 439/277

[58] Field of Search ..... 439/318, 278

[56] References Cited

U.S. PATENT DOCUMENTS 3,210,720 10/1965 Harris .
3,688,244 8/1972 Savoca et al. .
3,885,849 5/1975 Bailey et al. .
4,629,269 12/1986 Kailus .
4,653,839 3/1987 Powell .
4,676,573 6/1987 Norman ..... 439/318
4,758,175 7/1988 Didier et al. .
4,810,209 3/1989 Punako et al. .
4,904,208 2/1990 Powell et al. .

FOREIGN PATENT DOCUMENTS 0 128 472 12/1984 European Pat. Off. .

*Primary Examiner*—Neil Abrams
*Assistant Examiner*—Christopher Goins
*Attorney, Agent, or Firm*—Ronald P. Kananen; John H. Mulholland

[57] ABSTRACT

In order to seal an electrical connector in a manner wherein mating of the connector components does not deteriorate environment sealing elements or require periodic maintenance, a GRAFOIL® type end seal is arranged to be abutted by a leading edge portion of one of a male plug member and a female receptacle members in a manner which establishes the sole hermetic seal for the connector.

3 Claims, 5 Drawing Sheets

HERMETICALLY SEALED CONNECTOR DEVICE

This application is a continuation of application Ser. No. 08/542,457 filed Oct. 12, 1995 now abandoned.

BACKGROUND OF THE INVENTION

1. Field of the Invention

The present invention relates to a hermetically sealed connector device. More specifically, the present invention relates to a connector device which is suited for use in radioactive and the like type of adverse or hazardous environments, which exhibits a long working life, and which obviates the need for periodic service to replace sealing members and the like which deteriorate with exposure and/or connection and disconnection operations.

2. Description of the Related Art

U.S. Pat. No. 4,540,230 issued to Iversen et al. discloses a weatherproof sealed connector device which comprises a male member and a female member which can be selectively interconnected and disconnected. This arrangement however, features the use of a plurality of O-rings and exhibits the drawbacks that, when used in hazardous environments such as those which are highly radioactive, the O-rings which form a vital part of the sealing arrangement deteriorate either with the passing of time or due to connection and disconnection operations.

More specifically, replacement of one or more of the O-rings in the connector is required when there is evidence of degradation or other factors which may compromise the ability of the O-rings to maintain the required degree of sealing. Typically, replacement is required due to: material breakdown wherein the organic material from which the O-rings are made, degrades as a result of either exposure to a harsh radioactive environment; physical degradation wherein foreign matter such as a chip or a burr is present in one of male and female components of the connector and abrades the O-rings, or wherein one of the O-rings becomes partially dislodged from its groove and is caused to tear; or inadequate lubrication provided during scheduled applications of O-ring lubricate results in one or more of the O-rings tearing when the connector components are mated.

Further drawbacks encountered with this type of connector reside in that they are typically located in contaminated and radioactive environments wherein maintenance personnel are exposed to a general area radiation field as high as 1000 mR/hr. This of course limits the amount of work that can be done by any one operator in that typical administrative exposure limits in nuclear utilities are on the order of 2000 mR for an entire year. Further, in order to gain access to the connectors, it is necessary to construct scaffolding which again consumes considerable amounts of the permissible exposure time. In addition to this, small items such as the O-rings are difficult to handle and are easily mishandled and lost by operators who are clad in a full set of protective anti-contamination clothing including cumbersome rubber gloves.

SUMMARY OF THE INVENTION

It is an object of the present invention to provide a connector of the above described type which is devoid of O-rings and the need for these elements.

It is another object of the invention to provide a connector which can be mated without fear of degrading the sealing members, which does not require periodic seal lubrication or maintenance.

It is a further object of the invention to provide a connector which relies exclusively on a GRAFOIL® (graphite based seal constructed from layers of graphite and aluminum foil) end seal to provide the sufficient sealing to allow the complete omission of the problematic O-rings.

The concept of eliminating the dual O-ring environmental seal from the arrangement disclosed in U.S. Pat. No. 4,540,230 and using the GRAFOIL® gasket alone as the environmental seal was first considered by the inventors in 1994. Prior to this time there was a general presumption that the O-rings could not be omitted without compromising the required environmental seal. The use of the GRAFOIL® seal as the only environmental seal was discovered to eliminate all of the above mentioned C-ring failure mechanisms while providing the required environmental sealing. That is to say, a GRAFOIL® seal is impervious to the harsh radioactive environment, is not susceptible to tearing and damage due when used in a compression type end seal disposition, and requires no periodic lubrication to maintain its functionality.

More specifically, a first aspect of the present invention resides in a connector device which features a male plug comprising: a first housing; a first electrically insulative member disposed in the housing; a plurality of spaced connector pins disposed in the first member and arranged to project from a front end of the first member; and a first sleeve which is integral with the first housing and which encloses the pins; a female receptacle comprising; a second housing; a second central electrically insulative member disposed in the second housing; a plurality of spaced, connector pin-receiving passageways which are supported in the second member, the passageways being arranged to receive the plug pins and establish an electrical connection therewith; a second sleeve concentric with and peripheral to the second tubular member, the second sleeve being integral with the second housing and adapted to receive the first sleeve therein; locking means for releasably locking the first sleeve in the second sleeve; and a single graphite based sealing means supported on the second tubular member for engaging the leading annular edge of the first sleeve and for establishing the sole hermetic seal between the male plug and the female receptacle.

A second aspect of the present invention resides in a connector comprising: a male plug member and a female receptacle member, the male plug member and the female receptacle members respectively having sleeve portions which telescopically enclose one another; and end seal means, comprising a GRAFOIL® seal, for abutting a leading edge portion of one of the male plug member and female receptacle member and for exclusively establishing a hermetic seal which protects electrical connectors respectively included in the male plug member and the female receptacle.

A third aspect of the invention resides in a connector which features: a male plug member and a female receptacle member, the male plug member and the female receptacle member respectively having sleeve portions which telescopically enclose one another; and an O-ring free seal means for providing an environment seal which establishes a hermetic seal which protects electrical connectors respectively included in the male plug member and the female receptacle.

BRIEF DESCRIPTION OF THE DRAWINGS

The various features and advantages of the present invention will become more clearly appreciated from the following description of the preferred embodiments taken in conjunction with the appended drawings wherein.

DETAILED DESCRIPTION OF THE PREFERRED EMBODIMENT

Figure 1:
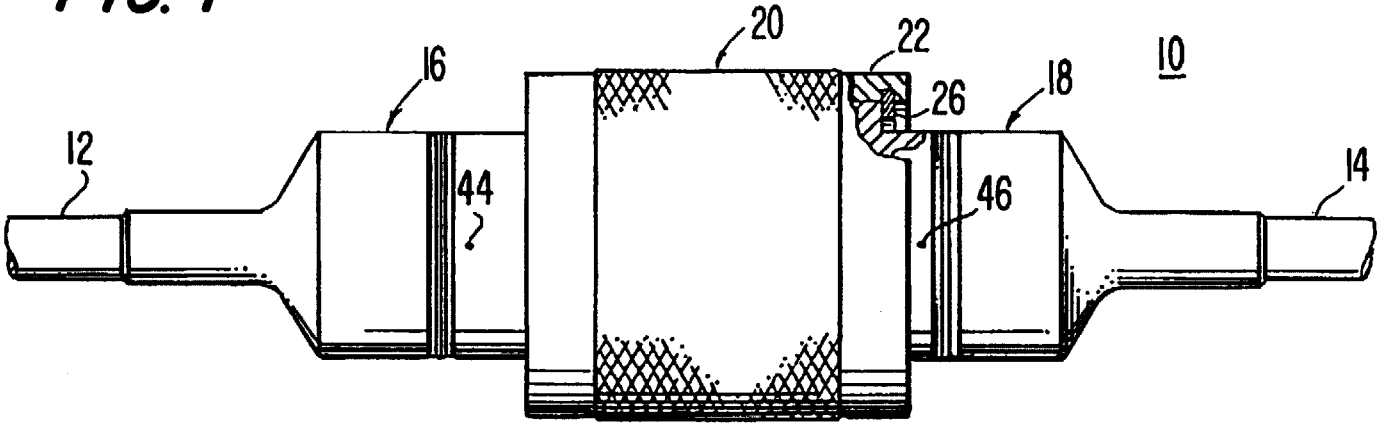
FIG. 1 is a side view showing a connector embodying the present invention.
Figure 2:
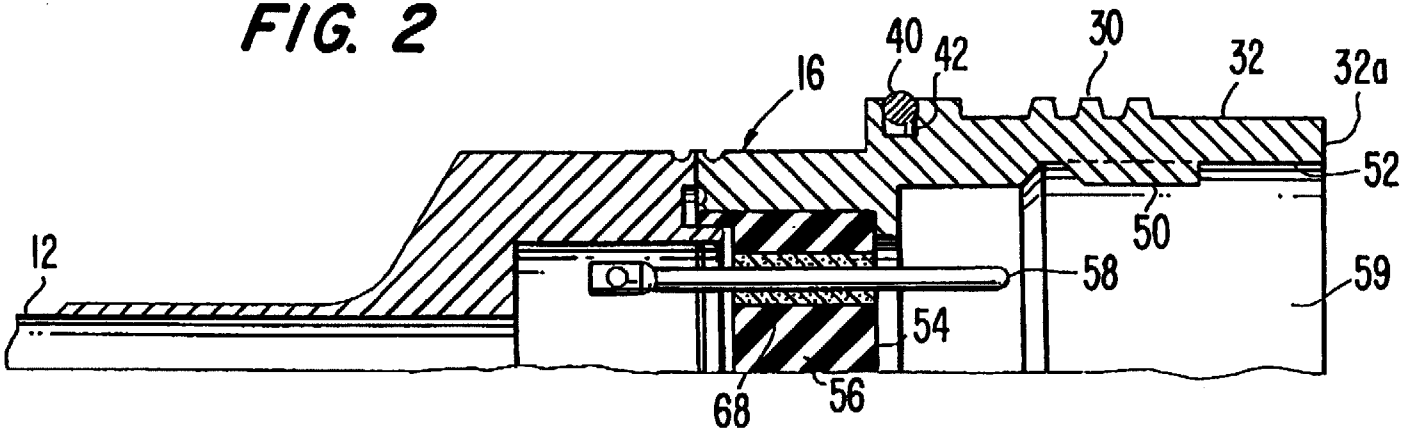
FIG. 2 is a side sectional view showing a male plug component of the connector shown in FIG. 1.

FIGS. 1 to 4 show a first embodiment of the present invention. In this embodiment, the connector device 10 is shown connected to cable ends 12 and 14, as by welding, brazing or the like, and comprises a male plug component 16 releasably secured to a female receptacle component 18, by a locking device 20 which includes a knurled internally threaded sleeve 22.

Figure 3:
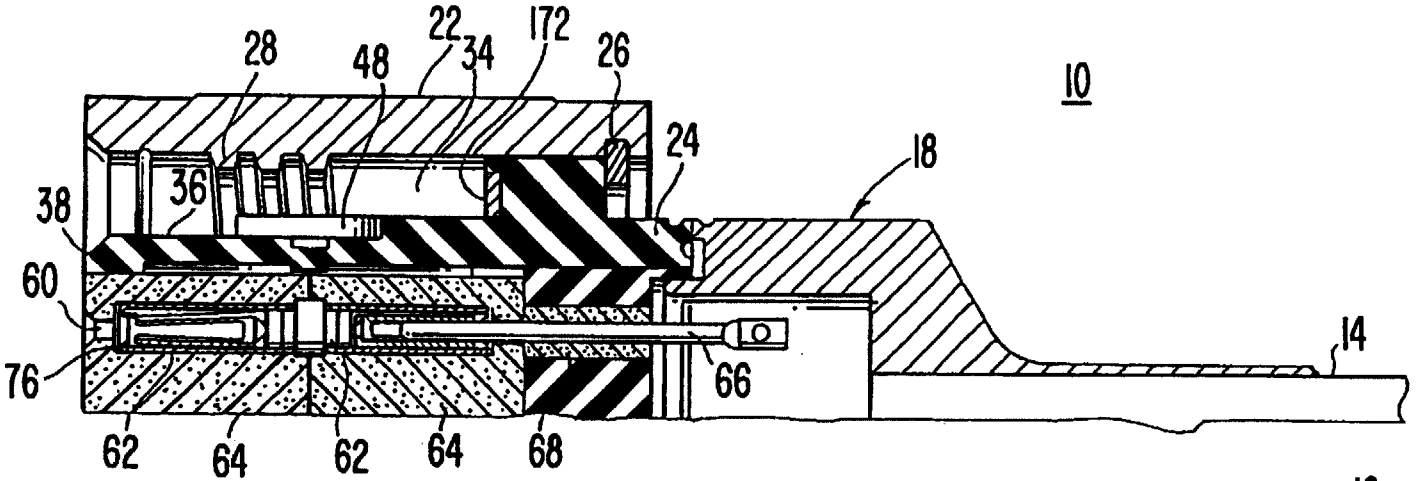
FIG. 3 is a side sectional view showing a female receptacle component of the connector shown in FIG. 1.

As shown particularly in FIG. 3 of the drawings, a sleeve 22 forms part of the female receptacle component 18, and is secured to a central tubular member 24 by a retainer ring 26 in a manner which allows the sleeve 22 to freely rotate around the central tubular member 24. The internal threads 28 of sleeve 22 engage external threads 30 of male plug component 16 (FIG. 2) when the forward cylindrical sleeve 32 of component 16 is inserted into an annular space 34 in the female receptacle component 18. As will be appreciated from the figures, this space 34 is defined by the sleeve 22 and a peripheral surface 36 of a front portion 38 of the female receptacle component 18. A C-shaped retainer spring 40 is disposed in a groove 42 in the exterior surface of the male plug portion 16 in a manner wherein it engages an inner surface of the sleeve 22 to resist relative rotation between the two components which may lead to unlocking in the event that the device 10 is subjected to substantial vibration.

In order to facilitate alignment of the plug 16 for insertion into the receptacle 18, alignment dots or marks 44 and 46 may be provided in the outer surface of the male plug 16 and the female receptacle 18, respectively. The front portion 38 of the receptacle 18 may also be provided with longitudinally extending aligning slots 48 adapted to receive detents 50 in the inner surface 52 of the sleeve 32.

A central tubular component 56 which forms a part of the male plug component 16 is provided with a plurality of forwardly extending, spaced, parallel electrically conductive pins 58. These pins 58 extend forwardly from a front surface 54 of the tubular component 56 into a space 59 which is defined within the sleeve 32, in the manner illustrated in FIGS. 2 and 4. The pins 58 are dimensioned and arranged such that when the sleeve 32 is fully locked with receptacle 18 in a manner wherein it extends fully into space 34, the pins 58 become fully received in spaced parallel passageways 60 defined in the front portion 38, which acts as a pin receiver. The pins 58 are firmly engaged by internal electrically conductive linings 62 provided in the passageways 60. These linings 62 resiliently grip the external surfaces of the pins 58 and establish frictional forces which help to hold the male plug 16 and female receptacle 18 together.

The passageways 60 extend longitudinally through a central thermally insulative core 64 of the central tubular member 24. In this embodiment, the insulative core 64 is made of a dielectric ceramic material or the like. The passageways 60 are lined throughout with electrically conductive materials 62 and are provided with rear pins 66 which are made of a ferrous alloy or other suitably electrically conductive material which can be soldered or otherwise suitably connected with the cable 14. The pins 58 extend longitudinally through a thermally insulative core 68 which is made of a dielectric ceramic or the like and embedded in the central tubular component 56, and are electrically connected with cable 12.

When the male plug 16 and the female receptacle 18 are fully engaged, the front and middle portions 38, 70 of tubular member 24 extend into and are received within a space 59 in the male plug 16. In such a position, the leading edge **32*a* of the sleeve 32 abuts a GRAFOIL® seal 172 which is disposed on a radially extending face of the central tubular member 24. The GRAFOIL® seal undergoes axial compression as the sleeve 22** is tightened via rotation, and establishes, in this embodiment, a single hermetic seal which is, according to the discovery which underlies the present invention, sufficient to hermetically seal the connector to at least the same degree as is possible with that arrangement disclosed in the above mentioned U.S. Pat. No. 4,540,230.

Because pins 58 fit firmly into linings 62, the force with which this end seal is maintained is additionally stabilized particularly with respect to external vibration and the like.

The positive locking nature of the locking device 20 adds further assurance that the desired seal will not be breached and that the electrical conductivity provided by connector 10 will not be impaired.

The linings 62 may be provided with a napkin split ring type of spring configuration and may be further provided with a protective hood portion having an inwardly rolled front end 76 to serve as a pin alignment guide. Linings 62 and their component parts can be fabricated of any suitable electrically conductive material which affords the desired spring gripping effect. Such material can include ferrous or non-ferrous metal alloys or the like. The hood 76 can be, for example, made of stainless steel as can the sleeve 32, the sleeve 22, the main bulk of male plug 16 and female receptacle 18, and those parts of the tubular members 24 and 56 which are disposed about the central thermally insulative cores 64 and 68.

Figure 4:
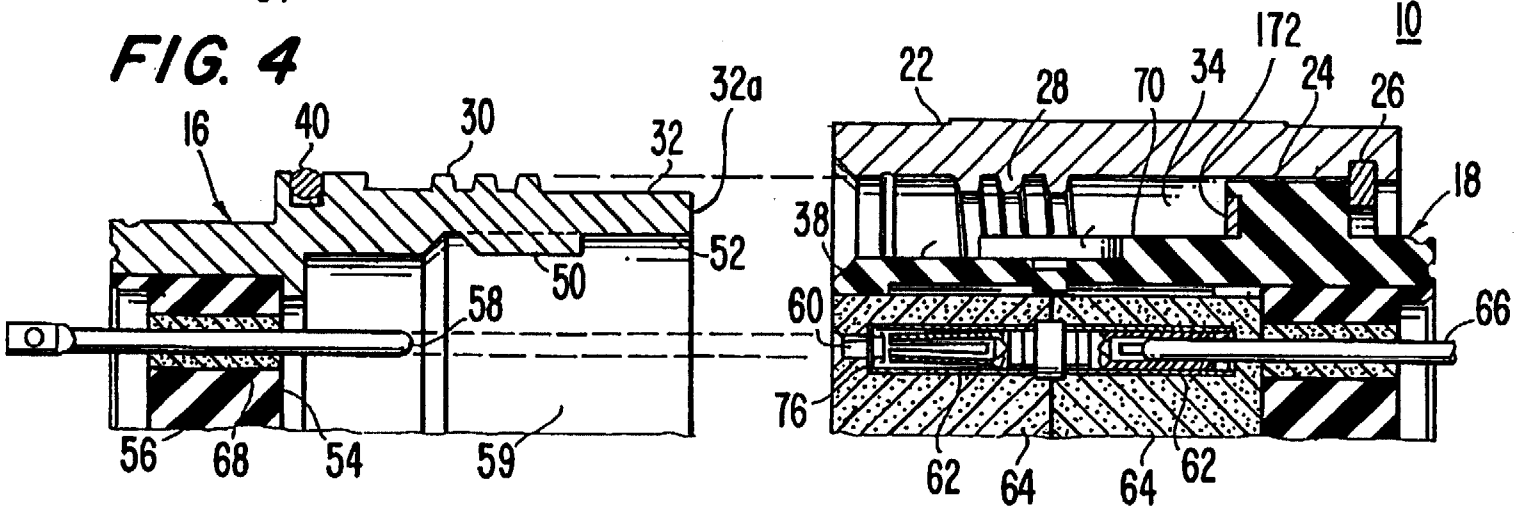
FIG. 4 is a view showing the male and female components separated from one another and showing the manner in which mating connection is achieved between the two components.
Figure 5B:
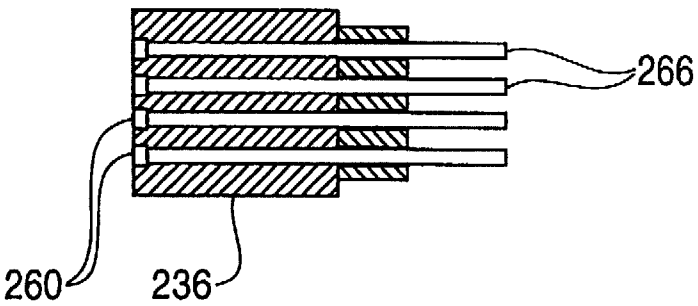
FIGS. 5A, 5B show the manner in which the electrical connectors are disposed in a non-conductive support in connection with an alternative connector design which may be employed in accordance with the present invention.
Figure 5A:
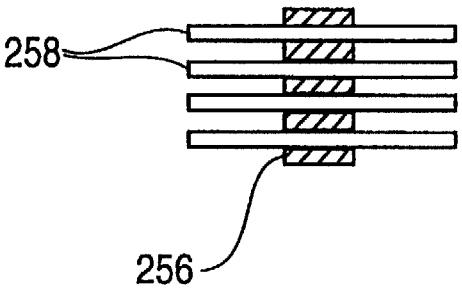

The male plug 16 and the female receptacle 18 can be readily soldered or brazed to cables 12, after the pins 58 and 66 as are electrically connected in the previously described manner. Once the cables 12 and 14 are electrically connected to the male plug 16 and female receptacle 18, the latter two components can be easily aligned with each other, as shown in FIG. 4, using reference marks 44 and 46 (FIG. 1) and then fully engaged so that pins 58 fit snugly into the passageways 60. Locking sleeve 22 is then rotated until the male plug 16 is locked into the female receptacle 18. Under these conditions, the spring 40 helps maintain the sleeve 22 in its fully locked position. Of course, the male plug 16 and female receptacle 18 can be just as easily unlocked and uncoupled merely by reversing this procedure.

The ease of alignment of the male plug 16 with the female receptacle 18 and the ease with which locking and unlocking these two components can be accomplished facilitates their use in such applications as nuclear reactors and the like where many connections may be required and coupling and uncoupling of connectors are called for. Most importantly, the connector 10 according to the present invention, provides a single seal arrangement which is free of O-rings and is therefore free from the drawbacks associated with such types of sealing elements. The simplicity and long life of such as simple seal greatly attenuates the amount of time that a worker is required to spend exposed to the health endangering effects of radiation while surprisingly providing a completely adequate hermetic seal.

Thus, the device 10 is simple, effective, durable and efficient, and can result in a great saving of time and effort and thus a great saving in expense when used for the installation and maintenance of a plurality of cables as in nuclear reactors and other power facilities which are particularly subject to corrosive high temperature environments. Device 10 can be fabricated from readily available conventional materials.

FIGS. 5A to 7B show the manner in which the pins and pin receiving passageway structures can be mounted in non-conductive supports and disposed in the respective male plug and female receptacle housings. In this alternative connector design, the electrical contacts 258, 266 are respectively glass sealed into modular disks 256, 236, which are welded into standard size connector shells or connector bodies 216, 218. In this manner, each part of the connector is fabricated from two discrete elements and can be configured with any desired arrangement and number of contacts and then welded into standard size connector shells. As will be appreciated, this process allows the manufacturing efficiency of one connector shell size for all applications while allowing variations and interchangeability for customer specific electrical contact requirements.

Figure 6B:
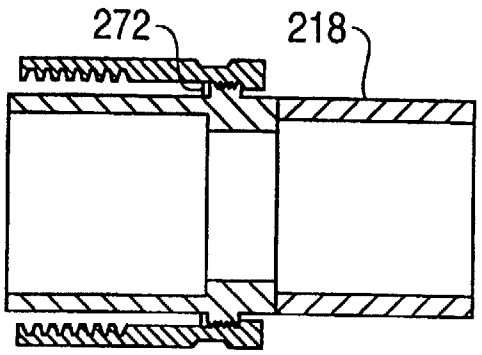
FIGS. 6A, 6B, show male plug and female receptacle housings into which the structures shown in FIGS. 5A and 5B can be respectively disposed; and 7A and 7B show the male and female connectors in a fully assembled condition.
Figure 6A:
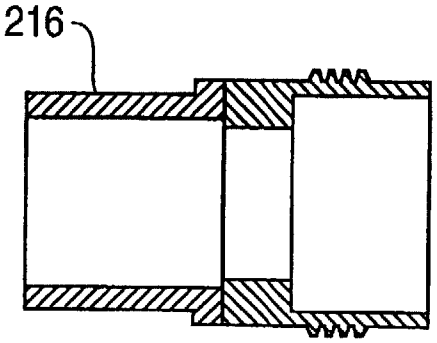
Figure 7B:
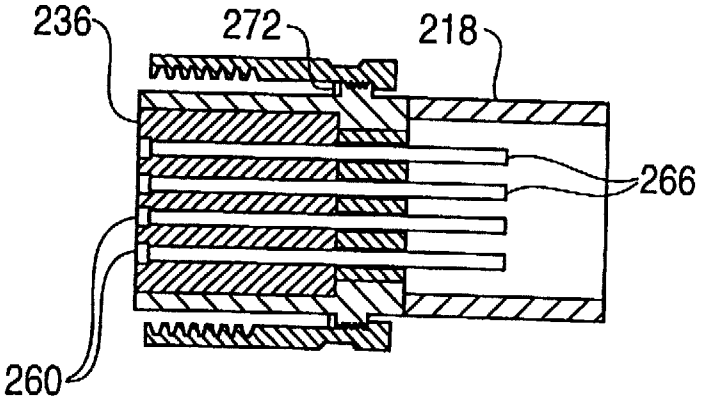
Figure 7A:
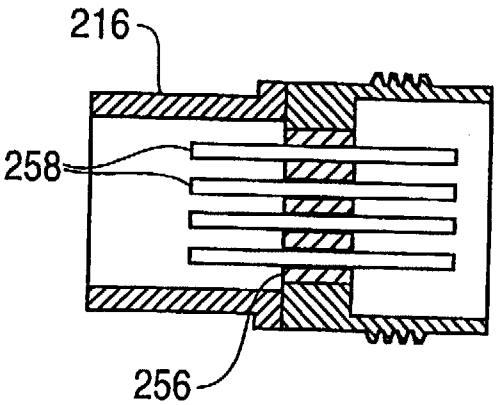

The GRAFOIL® end seal which characterizes the present invention is shown at reference numeral 272 in FIGS. 6B and 7B.

Although only one embodiment of the present invention has been described above, the various modifications, changes, alterations and additions which can be can be made without departing from the scope of the present invention, which is limited only by the appended claims, will be self-evident to those skilled in the art to which the invention pertains. By way of example, it is within the scope of the present invention to provide a second and/or alternate GRAFOIL® seal in the male plug member and arrange for a portion of the support in the female receptacle member in which the pin receiving members are mounted, abut the second seal.

What is claimed is:

1. A connector device comprising:

a male plug comprising:

a first single piece metallic housing;

a first electrically insulative elastomeric member disposed in said first single piece metallic housing;

a plurality of spaced connector pins supported by a first thermally insulative core member which is disposed in said first elastomeric member, said connector pins being arranged to project from a front end of said first elastomeric member; and a first sleeve which forms a part of said first single piece metallic housing and which encloses said pins; and a female receptacle comprising;

a second elastomeric housing;

a plurality of spaced, connector pin-receiving passageways which are supported in said second elastomeric housing by thermally insulative core means, said passageways being arranged to receive said plug pins and establish an electrical connection therewith;

a second sleeve which is rotatable supported on said second elastomeric housing so as to be concentric with and peripheral of said second elastomeric housing, said second sleeve being adapted to telescopically receive said first sleeve;

locking means for releasably locking said first sleeve in said second sleeve, said locking means including an internal thread formed on an inner diameter of said second sleeve which engages an external thread formed on said second sleeve of said male plug member; and sealing means, which is free of O-rings and which comprises a single seal element which is supported on a radially extending face of said second elastomeric member, for engaging a leading annular edge of said first sleeve and for exclusively establishing a sole hermetic seal between said male plug and said female receptacle.

2. A connector comprising:

a male plug member and a female receptacle member, said male plug member and said female receptacle member respectively having sleeve portions which telescopically enclose one another, the sleeve portion on the female portion being relatively rotatable with respect to the sleeve formed on the male portion and formed with thread on its inner surface which is engageable with a thread formed on an external surface of the sleeve of the male plug member for locking the male plug member and the female receptor member together; and end seal means, comprising a single graphite based seal abuttable with a leading edge portion of one of said male plug member and female receptacle member, for exclusively establishing a sole hermetic seal between said male plug member and said female receptacle and which protects electrical connectors respectively included in said male plug member and said female receptacle, wherein said female receptacle member is formed of an elastomeric material and extends coaxially within the rotatable sleeve member of the female receptacle member, said female receptacle member having a radially extending shoulder against which the graphite based seal is disposed.

3. A connector device comprising:

a first metallic housing;

a first electrically insulative elastomeric member disposed in said first metallic housing;

a plurality of spaced connector pins supported by a first thermally insulative core member which is disposed in said first elastomeric member, said connector pins being arranged to project from a front end of said first elastomeric member;

a first fixed sleeve which forms a part of said first metallic housing and which encloses said pins;

a second elastomeric housing;

a plurality of spaced, connector pin-receiving passageways which are supported in said second elastomeric housing by thermally insulative core means, said passageways being arranged to receive said plug pins and to establish an electrical connection therewith;

a second metallic sleeve which is rotatably supported on said second elastomeric housing so as to concentric with and peripheral of said second elastomeric member, said second sleeve being adapted to telescopically receive said first fixed sleeve;

locking means for releasably locking said first sleeve in said second sleeve, said locking means including an internal thread formed on an inner diameter of said second metallic sleeve and an external thread formed on said first fixed sleeve; and a single seal element which is supported on a radially extending face of said second elastomeric member, for sealingly engaging a leading annular edge of said first sleeve.

* * * * *